US006125928A

United States Patent [19]

Ninivaara et al.

[11] Patent Number: 6,125,928

[45] Date of Patent: Oct. 3, 2000

[54] SYSTEM FOR CONTROLLING AND STOPPING OIL DRILLING FIRES

[75] Inventors: Tarmo Ninivaara, Koria; Tero Hurtta, Helsinki; Juhani Ninivaara, Koria, all of Finland

[73] Assignee: AB Grundstenen AB (Metal Patent WHSS AB), Haparanda, Sweden

[21] Appl. No.: 09/332,681

[22] Filed: Jun. 14, 1999

Related U.S. Application Data

[63] Continuation of application No. PCT/FI97/00593, Oct. 1, 1997.

[30] Foreign Application Priority Data

Dec. 16, 1996 [FI] Finland ..... 964068

[51] Int. Cl.[7] ..... E21B 29/08

[52] U.S. Cl. ..... 166/55; 137/318; 166/97.1; 169/69

[58] Field of Search ..... 166/298, 55, 95.1, 166/97.1, 90.1; 137/318; 169/69

[56] References Cited

U.S. PATENT DOCUMENTS

| | | | |
|---|---|---|---|
| 2,000,381 | 5/1935 | Duffy | 166/90.1 |
| 2,840,166 | 6/1958 | Eckel et al. | 166/55 |
| 3,277,964 | 10/1966 | Houpeurt et al. | 166/285 |
| 3,647,174 | 3/1972 | LeRouax . | |
| 3,716,068 | 2/1973 | Addison . | |
| 3,717,202 | 2/1973 | Burrow . | |
| 3,905,424 | 9/1975 | Elwood et al. | 169/46 |
| 3,993,137 | 11/1976 | Hefetz | 169/46 |
| 4,095,421 | 6/1978 | Silcox . | |
| 4,193,574 | 3/1980 | Barnes et al. . | |
| 4,440,232 | 4/1984 | LeMoine . | |
| 4,626,135 | 12/1986 | Roche . | |
| 5,074,518 | 12/1991 | Berry . | |
| 5,076,311 | 12/1991 | Marschke . | |
| 5,156,212 | 10/1992 | Bryant | 166/298 |
| 5,161,617 | 11/1992 | Marschke . | |
| 5,199,493 | 4/1993 | Sodder, Jr. | 166/297 |
| 5,217,073 | 6/1993 | Bruns . | |
| 5,280,823 | 1/1994 | Chabot | 166/55 |
| 5,623,994 | 4/1997 | Robinson | 166/379 |

FOREIGN PATENT DOCUMENTS

| | | |
|---|---|---|
| 41 16 473 | 11/1992 | Germany . |
| WO 92/16714 | 10/1992 | WIPO . |

*Primary Examiner*—Hoang Dang
*Attorney, Agent, or Firm*—Altera Law Group LLC

[57] ABSTRACT

System for controlling oil well fires by blocking the production or drilling pipes. A box incorporating a movable piston is fitted around the pipe. The piston carries, on its forward end, a drilling cylinder (3), which can be brought to the pipe by a hydraulic piston-cylinder arrangement. Subsequently, the drilling cylinder drills through the pipe wall and after that the drilling cylinder or a separate plugging cylinder (4) is left in the drilled hole and blocks the fluid flow through the pipe. The process is remote controlled.

40 Claims, 8 Drawing Sheets

SYSTEM FOR CONTROLLING AND STOPPING OIL DRILLING FIRES

This application is a continuation of international application Ser. No. PCT/FI97/00593, filed Oct. 1, 1997, pending.

FIELD OF THE INVENTION

The subject of the invention is a system to controll oil drilling fires or fires of other corresponding liauid substances. With this invention the eruption of burning substance is stopped so that the oil drilling pipe/pipes are blocked in a way which makes it possible for the pipes to be reopened.

BACKGROUND OF THE INVENTION

Presently there are three different ways to try to put out oil fires:

Water is sprayed on the seat of the fire while the fire fighter at the same time approaches the fire behind a protective shield and tries to shut down the valve of the oil pipe manually. The method is dangerous and requires a lot of water, which is not always available at the site of the fire.

By exploding the buring oil well the use of oxygen in the surrouding area is temporarily increased so much that the fire is suffocated by lack of sufficient oxygen. After this the valves and other broken equipment can be replaced. The method is very dangerous.

By drilling a new hole into the same oil well with the burning oil pipe and by pumping water into it the oil eruption is replaced by a water eruption and the fire is put out. This is an expensive and time consuming operation and the success of it cannot be guaranteed. Additionally it is dangerous to carry out.

SUMMARY OF THE INVENTION

The main parts of the equipment of this invention in question are: a hydraulic cylinder, a piston, a drilling cylinder, a plugging cylinder, a drill, a box clamp, a hydraulic motor or other power source, a blocking bolt, a hydraulic container with leads and a pressure battery and an automatic control and surveillance system. The idea is that each oil and/or gas drilling pipe within each other has its own drilling unit in accordance with pipe size. By the drilling unit we mean the drilling and plugging mechanism needed to close one oil or gas drilling pipe. Several drilling units can use a mutual energy source with its hydraulic container. In underwater conditions as on offshore oil drilling platforms the water pressure can be directed with its own mechanism to be used in the system. To create pressure also an expolsion inside a massive cylinder with pistons at both ends, can be used and this pressure is directed through a separate central container or directly into the hydraulic container. The pressure can also be taken from the oil or gas drilling pipe under the drilling units, through a drilled hole and a joint fixed to it. The necessary number of drilling units can be installed, which in the example is three.

The purpose of the system of this invention is to controll oil and/or gas fires so that the distruction of big oil and/or gas drilling equipment can be avoided. The equipment can be installed either to an oil and/or gas drilling system under construction, an oil and/or gas drilling system already constructed or even onto a burning one. Because the equipment is remote-installed and automatically controlled the oil fire does not pose a threat to humans, when the equipment has already been installed to the oil drilling system in advance and installing one on an already burning system does not necessitate going into the immediate proximity of the fire seat, on the contrary it is installed underground. Thus as advantages of the invention we can mention that the equipment and method are safe, they save the environment, money and oil or gas.

DESCRIPTION OF THE DRAWINGS

The invention is explained in more detail below with references to the enclosed drawing.

DETAILED DESCRIPTION

Figure 1:
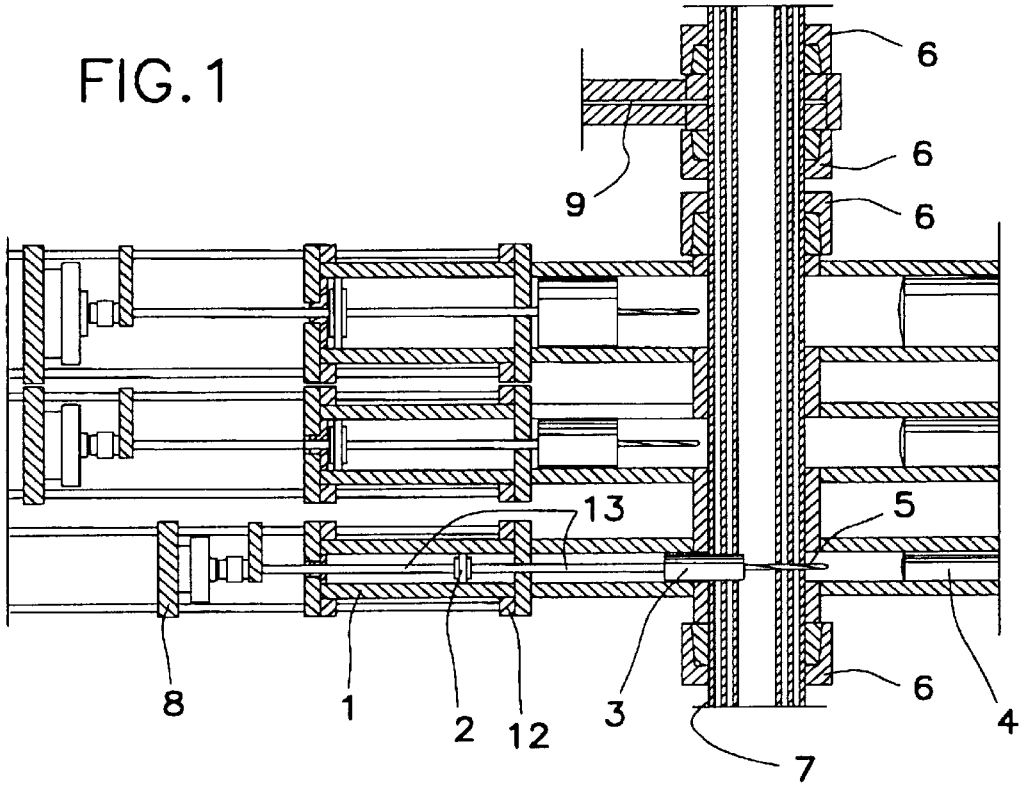
FIG. 1 shows a cross section of the equipment when the first drilling cylinder is in motion.
Figure 2:
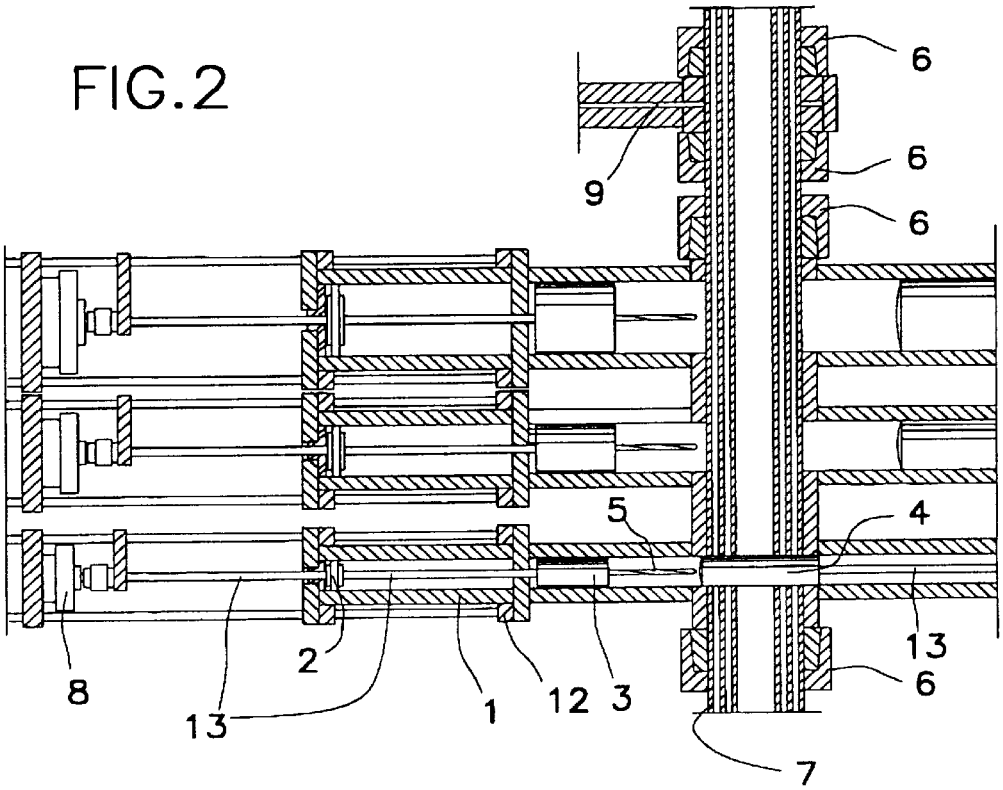
FIG. 2 shows a cross section of the equipment when the first plugging cylinder is in place.
Figure 3:
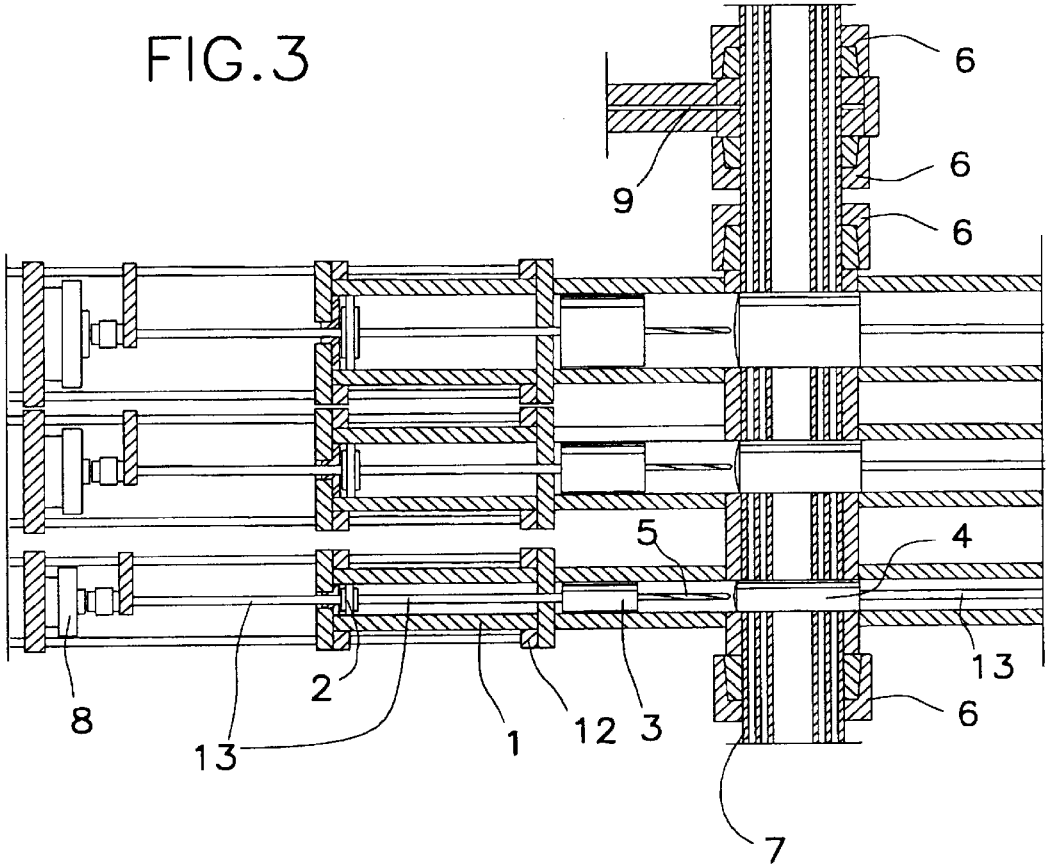
FIG. 3 shows a cross section of the equipment when all three plugging cylinders are in place.
Figure 4:
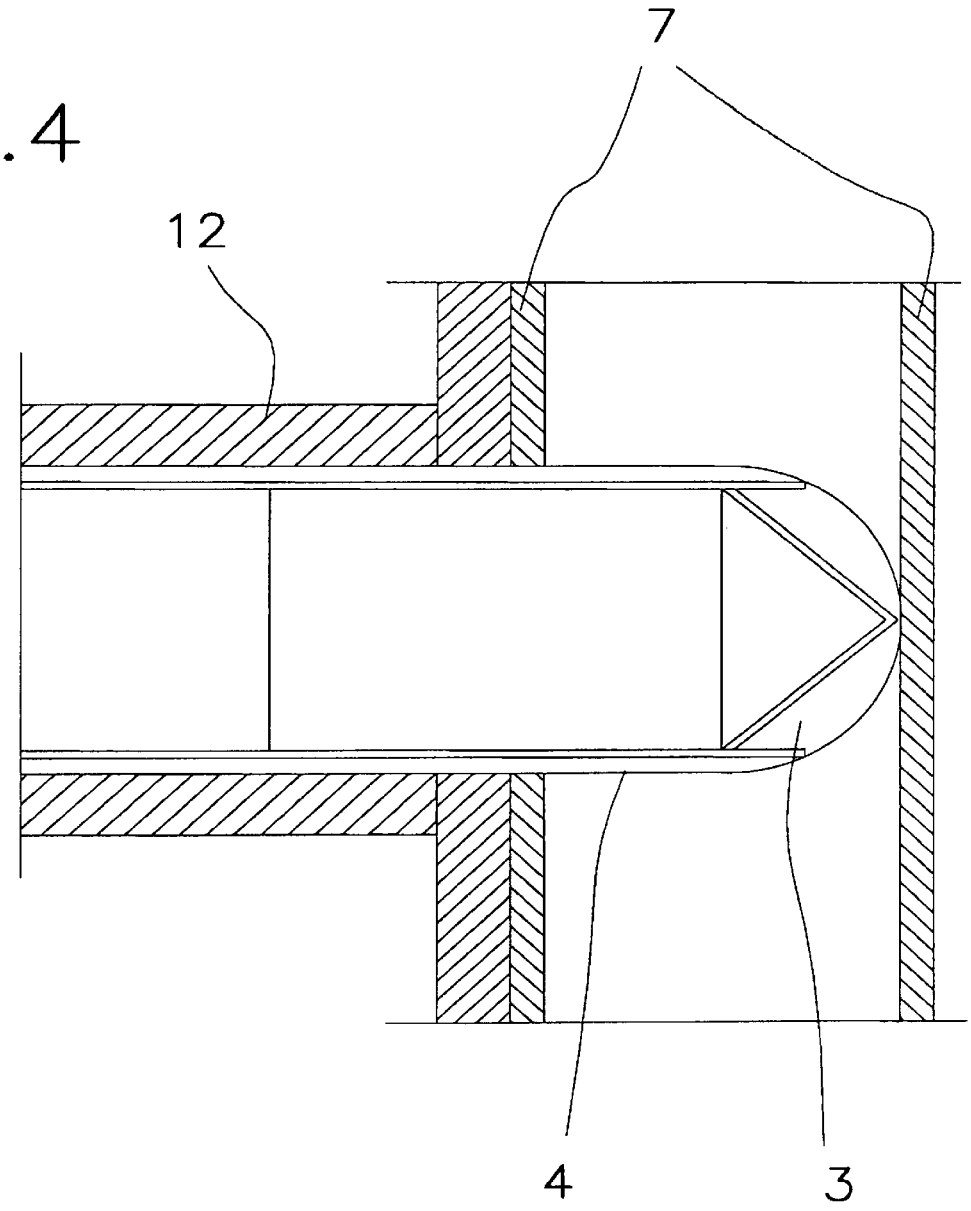
FIG. 4 shows a cross section of the hemispherical cylinder.
Figure 5:
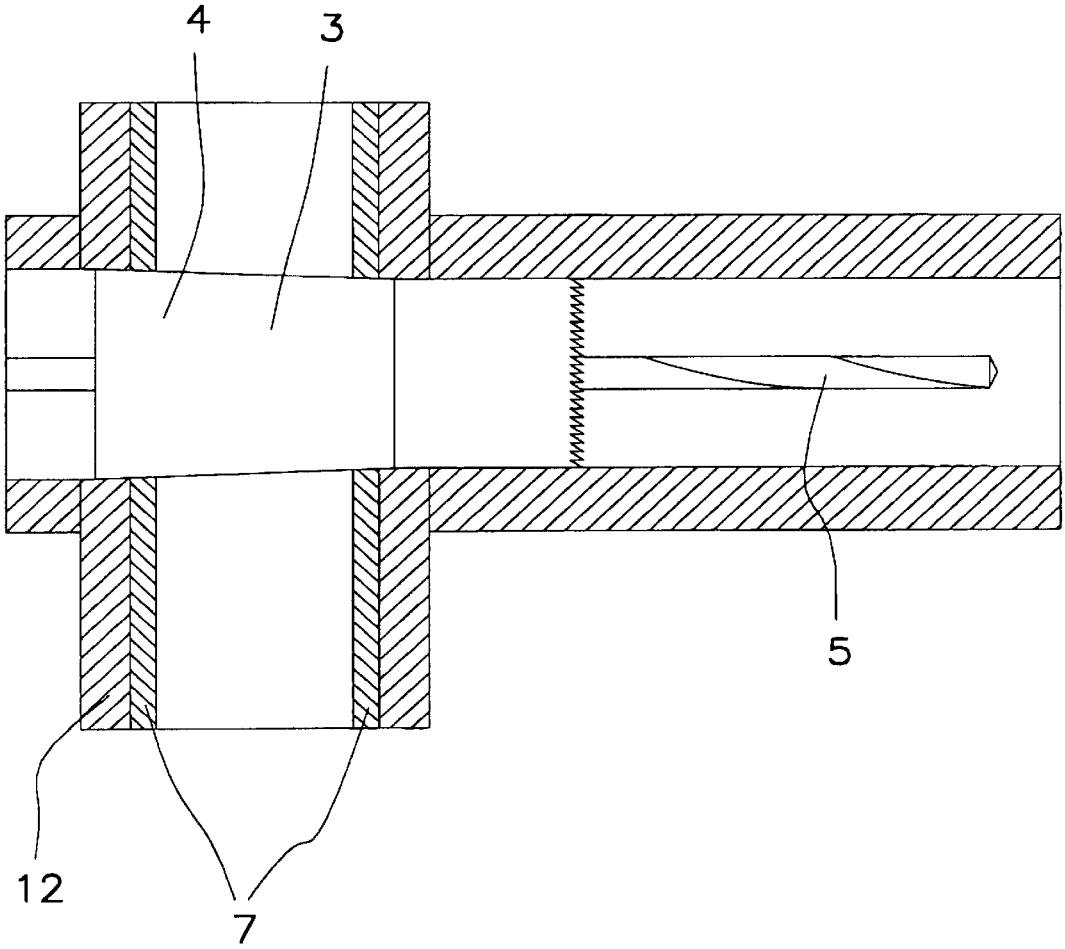
FIG. 5 shows a part cross section of the conical cylinder with the grinding surface.
Figure 6:
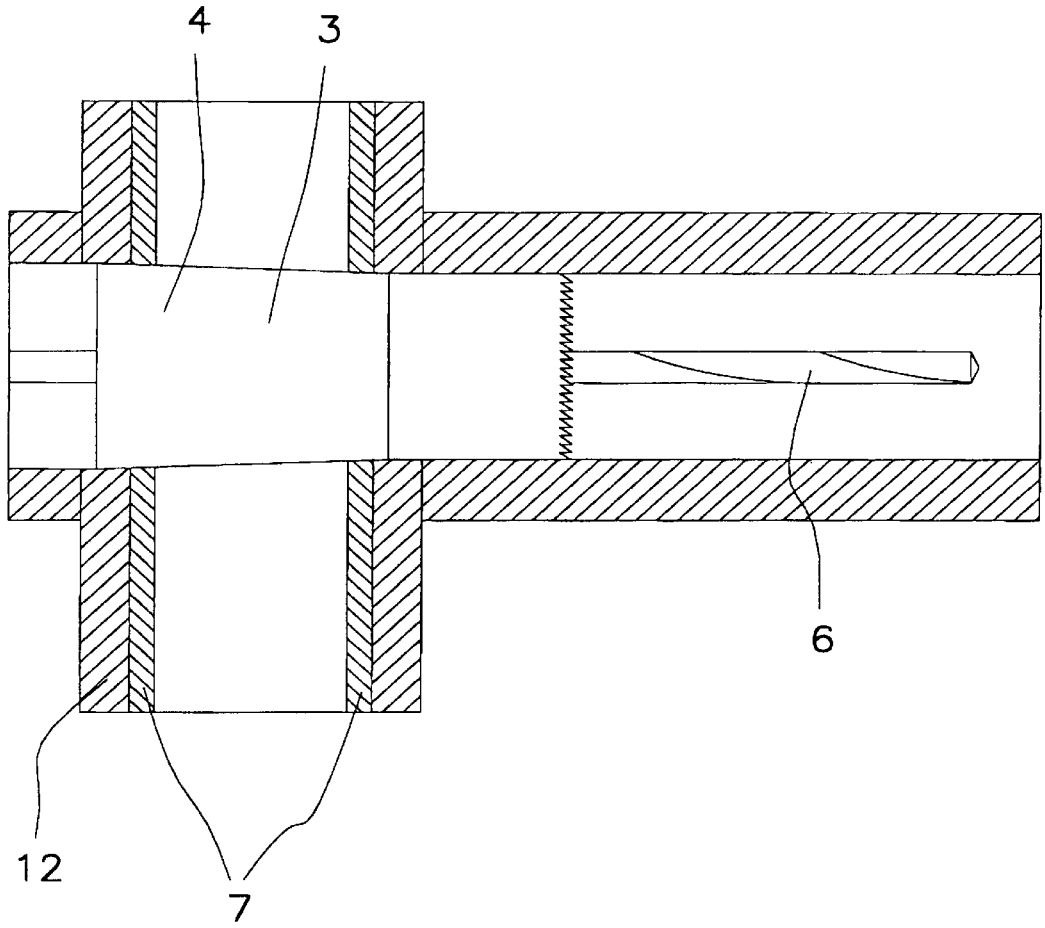
FIG. 6 shows a part cross section of the conical cylinder with protruding blade.
Figure 7:
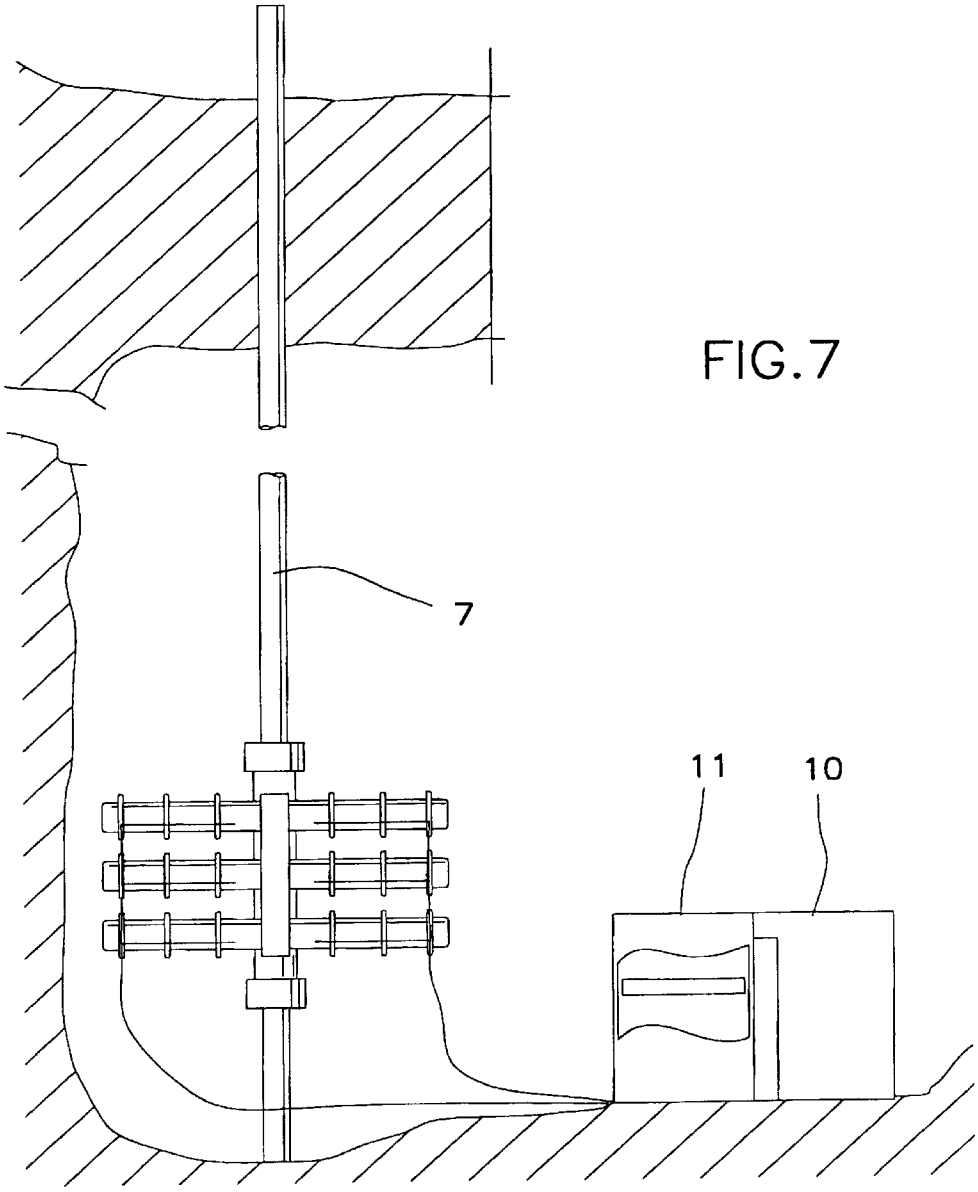
FIG. 7 shows the equipment installed and a part cross section of the hydraulic container. The figure does not shows the the space constructed under ground, where the equipment is situatéd.
Figure 8:
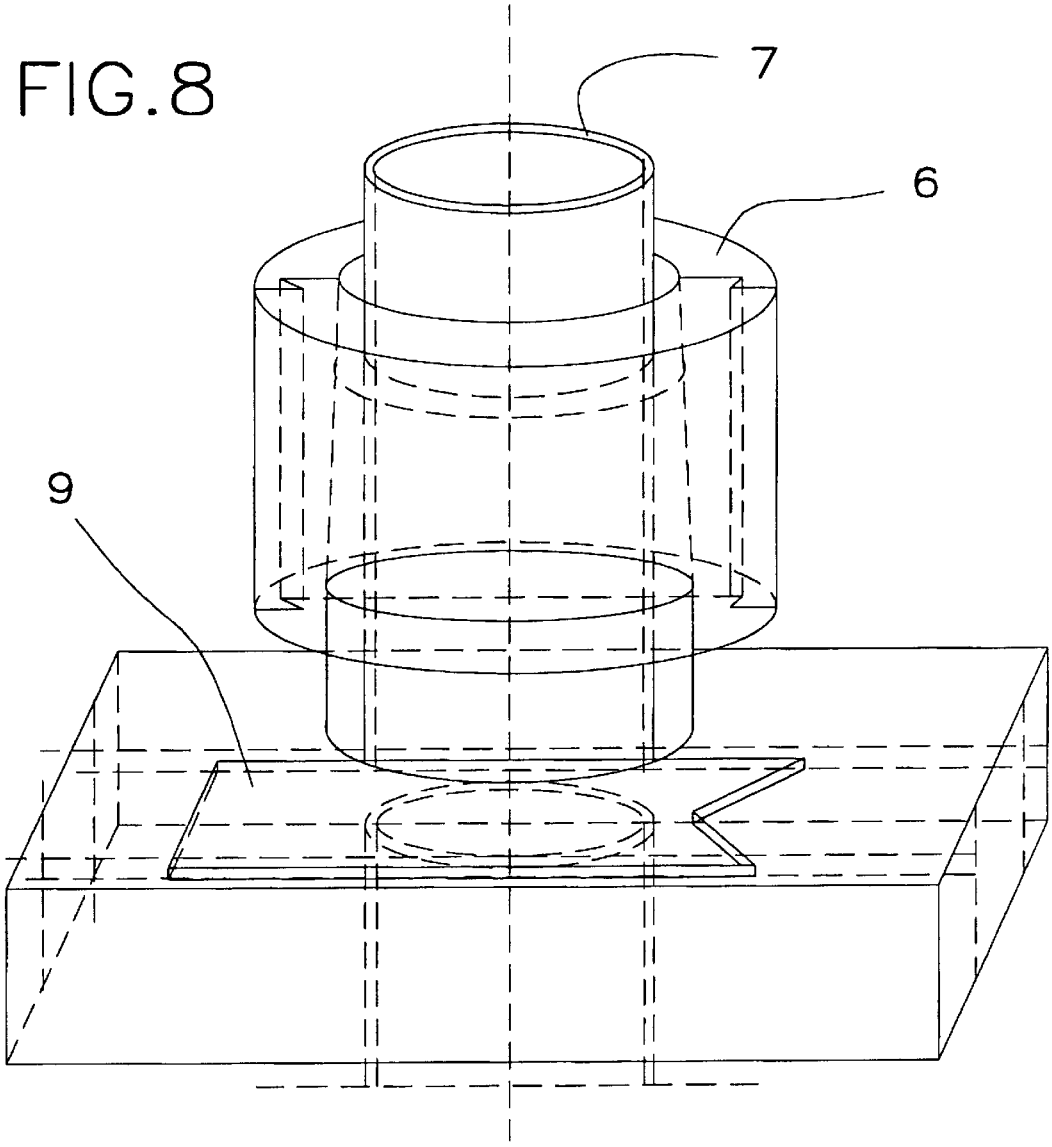
FIG. 8 is a picture detailing the box clamp and the locked blocking bolt.

In FIGS. 1, 2 and 3 the idea is that on the right hand side of the oil and/or gas drilling pipes and the plugging cylinder there is a similar pushing and/or rotating mechanism as on the left side of the oil and/or gas drilling pipes. It is also appropriate, deviating from the drawings, that drilling units operating one after the other are placed on opposite sides of the oil and/or gas drilling pipes so that successive drillings as well as pluggings are done starting from the opposite sides of the pipes. If there are three or more drilling units around the same oil and/or gas drilling pipes each can be placed to be started from completely different directions, thus making it possible to minimize resultant force caused to the pipes by the drilling and plugging.

When the equipment is started the pressure of the pressure batteries 10 is discharged into the hydraulic container 11, the pressure of which starts the operation of the hydraulic motor 8 and the valve. Oil flows into the hydraulic cylinder 1 which pushes the piston 2 and the piston pushes the drill 5 and the drilling cylinder 3 forward. When the drilling cylinder 3 has penetrated sufficently far that is through the oil drilling pipes 7, the mechanical reversing valve gives the command for the drill 5 and the drilling cylinder 3 to return and further gives the order for the plugging cylinder 4 to carry out the plugging. The plugging cylinder 4 can be placed also behind the drilling cylinder 3, in which case the motion is needed in only one direction. When all the drilling units have operated also the blocking bolt can be closed when necessary. This works either hydraulically or by explosives. The plugging cylinders can operate either only so they are pushed or they can be equipped with a rotating motor for example for grinding. At the time of the plugging or after the plugging a pressurized fire extinguishing substance such as liquid nitrogen can additionally be fed into the gas or oil drilling pipe. This is fed through a hole cut into the oil or gas drilling pipe by a device like the drilling cylinder 3. All this can be done without electricity, by forced controll, in which case once the operation is started it cannot be stopped. The equipment is fixed around the oil pipes with a box clamp 6 and supported to its base. By plugging pipes of various sizes separately the pipes on top are prevented from falling. By installing sleeve pipes in place of the cut ones and by pulling out the plugs the oil drilling system can be made operational again.

Figure 9:
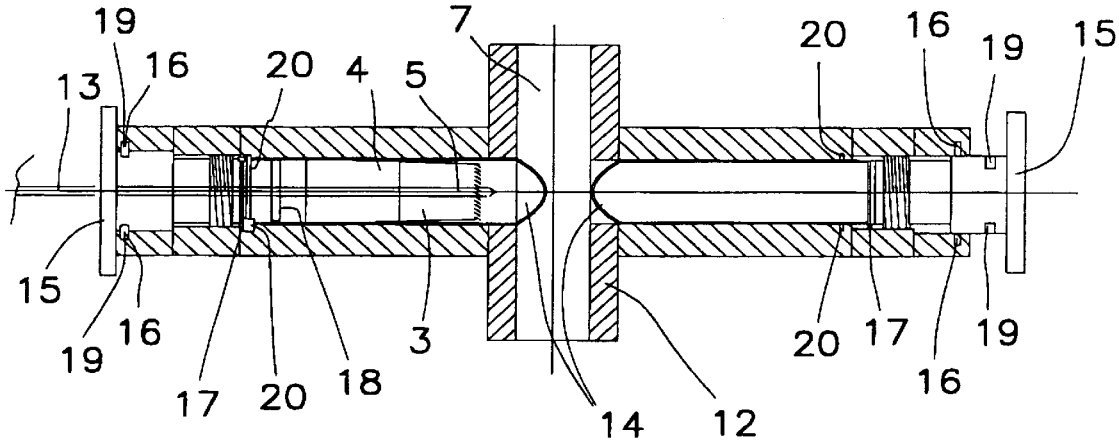
FIG. 9 shows an application in which the drilling cylinder and the plugging cylinder (which, however, are not drawn into the figure) operate beginning from the same side of the oil and/or gas drilling pipe and the above mentioned cylinders are directed by and the cutting seam sealed by means of a stuffing box. In the figure the stuffing box on the right hand side has not been tightened into place.

The following application can be used to block the outer oil or gas drilling pipe and the explanation refers mainly to FIG. 9:

In addition to the parts of the invention mentioned earlier the invention also includes a stuffing box 14, a tightener 15, blocking locks 16, a plain bearing (for example a chrome strip) 17, compressed oil packing 18, a locking groove 19 and a frame groove 20. The end of the stuffing box 14 which is facing the oil or gas drilling pipe is shaped in the form of the outside wall of the pipe in question and is very sharp, this is tightened into place with a plain bearing 17 and a tightener 15 with an outside thread to the inner thread of the frame 12 of the equipment either by hand during installation or by an automatized mechanism when the equipment is started. A locking groove 19 has been shaped around the tightener 15 of the stuffing box, into which the blocking locks 16 drawn to the frame 12 by springs/fluid pressure are pushed, when the tightener of the stuffing box has been pushed to the required depth. Additionally a frame groove 20 has been shaped into the frame 12 of the equipment, its purpose being to prevent, in addition to the tightener 15 of the stuffing box, the loosening of the stuffing box 14 when it has reached the fixed depth. The purpose of the stuffing box 14 which has been tightened into place and which is very sharp at the oil or gas drilling pipe 7 end and which is of a very hard material, is to seal the plugging seam of the oil or gas drilling pipe 7 being drilled and plugged and to direct the movement of the drilling-plugging combination 3–4 travelling within it. The seam between the stuffing box 14 and the axle 13 is sealed with a compressed oil packing. As the drilling proceeds the pieces drilled loose from the oil or gas drilling pipe 7 are left in the drilling-plugging combination 3–4.

The surveillance and control of the valve can operate:

1. By using known methods from the processing and automation technology.
2. By electrically measuring changes with sensors from the magnetic field of the system, these changes are caused for example by changes in the following quantities: flow rate, flow direction, temperature, pressure, stability. Changes taking place in the magnetic field are noted electrically by changes in several resistors, which are transistor directed and integrated by computer, and the operation of the valve is controlled by the limiting values coded into the computer. The underwater surroundings of the valve and changes in it can also be surveilled throught this method, and any observations, for example the threat of terrorism, is passed on to the surveillance and control terminal.
3. By analysing and coordinating quantities, such as temperature, pressure, speed of revolution and travelling speed, and changes in them measured by sensors in the tip of the drill and on the axle.

To control the valve we can use:

1. Independent valve controls, electrically connected: closing the valve needs only one command.
2. Control directly or indirectly from the hydraulic valve.
3. A hydraulic valve operated by pneumatics.

The operations can be connected either manually or automatically, in which case the system is started by the safety release of the independently closing system. As measuring quantities we can use temperature, gas content, pressure, flow, jolts, mechanics, electrical techniques or other such quantities, which give the valve instructions automatically also when it is not possible to do this by human power.

Sensors indicating operation can be installed on the valve which will show the operating status of the valve.

1. A pressure sensor in the hydraulic container showing the valve has started operating, indicating the working pressure of the oil.
2. A gauge showing the amount of oil indicating the distance of motion:
   - the amount of oil going into the cylinder indicates the distance of motion
   - the pressure sensor on the return side of the cylinder indicates the operation of the return motion.
3. The pressure sensor in the plugging cylinder indicates the plugging motion.
4. The sensor indicating the rotating of the drill is situated on the axle of the drill
5. A sensor situated in the tip of the drill can measure prevailing quantities.

Automatic data processing uses these quantities to form a picture detailing the operation of the valve onto the computer terminal.

What is claimed is:

1. Valve equipment for blocking oil or gas drilling pipes, comprising:

drilling and blocking mechanism having a frame mounted on support of a pipe to be blocked, the frame comprising a first frame part transversal to a direction of the pipe and disposed at a first side of the pipe, and a second frame part disposed at a second side of pipe opposite to the first side;

a hydraulically rotatable drill for boring through the pipe, the drill being arranged inside the first frame part to move transversally in relation to the direction of the pipe;

a plugging cylinder for plugging the hole bored through the pipe, the plugging cylinder being arranged inside one of the first and second frame parts to move transversally in relation to the direction of the pipe; and means for moving the plugging cylinder into a plugging position at the hole bored through the pipe;

wherein the drilling and blocking mechanism comprises stuffing boxes made of hard material and are disposed inside the first frame part and the second frame part between said frame part and the drill and the plugging cylinder for directing movement of the drill and the plugging cylinder, the stuffing boxes having sharp front ends facing the pipe, the front ends being shaped to the form of the outer wall of the pipe, and the stuffing boxes being movable and guided by said frame part transversally towards the pipe from opposite sides of the pipe for sealing the pipe tighteners being provided for pushing the stuffing boxes against the pipe and locking means being provided for locking the tighteners into a fixed position in relation to the frame parts.

2. Valve equipment of claim 1, wherein a guide means of the frame is provided with an inner thread and one of the tighteners is provided with an outer thread for co-operation with said inner thread.

3. Valve equipment of claim 1, wherein plain bearings are arranged between the tighteners and their associated stuffing boxes.

4. Valve equipment of claim 1, wherein the locking means comprises a frame groove at a cylindrical inner surface of the frame part, spring-biased blocking locks in the frame groove, and a locking groove around an outer surface of the tightener for receiving the blocking locks.

5. Valve equipment of claim 1, wherein the drilling and blocking mechanism comprises a compressed oil packing for sealing an axle which rotates the hydraulically rotatable drill to the stuffing box.

6. Valve equipment of claim 1, further comprising a plurality of drilling and blocking mechanisms arranged consecutively along the pipe, wherein, in each two adjacent drilling and blocking mechanisms, the boring directions of the drills through the pipe are opposite to each other.

7. Valve equipment of claim 6, wherein in each two adjacent drilling and blocking mechanisms, the blocking directions of the plugging cylinders are opposite to each other.

8. Valve equipment of claim 1, wherein the valve equipment comprises at least three drilling and blocking mechanisms.

9. Valve equipment of claim 1, wherein the drilling and blocking mechanism comprises an axle having a drilling cylinder provided with a drill, a power source for rotating the axle, a piston attached to the axle, and a hydraulic cylinder for moving the piston and the axle in the direction of the axle; and the valve equipment comprises box clamps, a blocking bolt, a pressure battery, a hydraulic container with lines, a mechanism to utilize hydrostatic water pressure, and an automatic control and surveillance system.

10. Valve equipment of claim 9, wherein a point of the drilling cylinder is ball-shaped and provided with a blade which is hydraulically projected and pulled back, whereby the drilling cylinder also comprises the plugging cylinder.

11. Valve equipment of claim 9, wherein the drilling cylinder is conical and is provided with a dynamic drill size regulator, and the plugging cylinder is conical.

12. Valve equipment of claim 1, wherein the plugging cylinder is hollow and lockable using at least one of oil pressure and explosive.

13. Valve equipment of claim 9, wherein the drilling cylinder is a cylinder with a bladed end.

14. Valve equipment of claim 9, wherein the drill (5) is disposed centrally at an end of the drilling cylinder.

15. Valve equipment of claim 9, wherein the drilling cylinder, plugging cylinder and the drill are disposed to receive their forward motion energy from pressure batteries through the piston, the axles, the hydraulic cylinder and the hydraulic container in addition to the lines.

16. Valve equipment of claim 9, wherein the drilling container and the drill are disposed to receive rotating motion energy from pressure batteries through the piston, the axles, a hydraulic motor used as the power source (8), the hydraulic container (11) and the lines.

17. Valve equipment of claim 9, wherein the box clamps are formed from a two-part structure for installation around the pipe.

18. Valve equipment of claim 9, wherein an inner side of the box clamp is conical and provided with a thread.

19. Valve equipment of claim 9, wherein the blocking bolt is lockable in place using one of explosives and hydraulics.

20. Valve equipment of claim 9, wherein the blocking bolt is wider than the pipe and has a tapering v-formed point.

21. Valve equipment of claim 9, wherein the drilling cylinder and the plugging cylinder each have an outside diameter larger than an inner diameter of the pipe and smaller than an outside diameter of the pipe.

22. Valve equipment of claim 9, wherein a blade of the drilling cylinder is disposed to project from the drilling cylinder when the drilling cylinder starts to rotate in a first rotation direction and retract into the drilling cylinder when the rotation direction changes.

23. Valve equipment of claim 9, wherein an outside surface of the drilling cylinder includes a grinding surface.

24. Valve equipment of claim 9, wherein the drilling cylinder is disposed to act as the plugging cylinder, and the drilling cylinder is arranged to be expandable using one of hydraulic and explosive force.

25. Valve equipment of claim 9, wherein the drilling cylinder and the plugging cylinder are both situated on one of a same side of the pipe and different sides of the pipe.

26. Valve equipment of claim 9, wherein the drilling units are placed on opposite sides of the pipe so that successive drillings are started from different sides of the pipe, and successive pluggings are started from different sides of the pipe.

27. Valve equipment of claim 1, wherein the valve equipment is arranged to be installable on a drilling system controlled by a plate.

28. Valve equipment of claim 1, wherein, in underwater conditions, hydrostatic water pressure is directed by a separate energy conversion mechanism into energy to be used by the drilling system.

29. Valve equipment of claim 1, further comprising means for measuring changes in magnetic field of the drilling system for continuous monitoring of the drilling unit as well as surroundings and for taking action required by the measured changes in magnetic field.

30. Valve equipment of claim 29, comprising equipment for measuring the changes in the magnetic field electrically, the changes being caused by changes in at least one of flow rate, flow direction, temperature, pressure, stability and material surrounding the pipe.

31. Valve equipment of claim 30, wherein the equipment for measuring the changes in magnetic field includes resistor and transistor sensors coupled to a computer, information on changes in electrical properties of the sensors being received and analyzed by the computer.

32. Valve equipment of claim 31, wherein information collected by the resistors and transistors is integrated into coded limiting values in the computer, the code limiting values being used in controlling operation of the valve and being transferred to surveillance and control terminal.

33. Valve equipment of claim 9, further comprising a massive cylinder coupled via leads to provide energy to the valve equipment from pressure caused by an explosion within the cylinder.

34. Valve equipment of claim 33, wherein air pressure caused by the explosion is directed into one of the hydraulic container and a separate central container coupled to the hydraulic container, the air pressure being coupled to the hydraulic container where the air pressure is first directed into the separate central container.

35. Valve equipment of claim 34, further comprising two axially parallel pistons positioned within in the massive cylinder and situated on different sides of a charge of explosive material.

36. Valve equipment of claim 1, further comprising a separate joint couplable to a hole drilled by the pipe to couple one of negative and excess pressure in the hole to the valve equipment as an energy source for powering the valve equipment.

37. Valve equipment of claim 1, further comprising a programmable computer coupled to control the valve equipment and to receive information from sensors disposed to measure operating conditions.

38. Valve equipment of claim 37, further comprising a transmitter to transmit information received from the sensors to a remote control center.

39. Valve equipment of claim 37, further comprising a source of a pressurized fire extinguishing substance couplable to be fed through a hole drilled in the pipe above the plugging unit or plugging units, through a separate joint.

40. Valve equipment of claim 39, wherein the source of pressurized fire extinguishing substance is arranged to feed the fire extinguishing substance into the pipe at a time corresponding to one of a time when the pipe is plugged by the plugging cylinder and a time independent of when the pipe is plugged by the plugging cylinder.

* * * * *